US012727674B2

(12) United States Patent
Gier et al.

(10) Patent No.: US 12,727,674 B2
(45) Date of Patent: Sep. 8, 2026

(54) PORTABLE CHAIR

(71) Applicant: YETI Coolers, LLC, Austin, TX (US)

(72) Inventors: Sergio Andrés Gier, Austin, TX (US); Dustin R. Bullock, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 165 days.

(21) Appl. No.: 18/594,621

(22) Filed: Mar. 4, 2024

(65) Prior Publication Data

US 2025/0275631 A1 Sep. 4, 2025

(51) Int. Cl.
*A47C 4/46* (2006.01)

(52) U.S. Cl.
CPC ..... *A47C 4/46* (2013.01)

(58) Field of Classification Search
CPC ... A47C 1/0365; A47C 1/103244; A47C 4/46; A47C 4/10; A47C 4/12; A47C 4/20; A47C 4/22; A47C 4/34; A47C 4/36; A47C 4/44
See application file for complete search history.

(56) References Cited

U.S. PATENT DOCUMENTS

| | | | |
|---|---|---|---|
| 3,175,269 | A | 3/1965 | Raduns et al. |
| 3,715,142 | A | 2/1973 | Lay et al. |
| 3,844,612 | A | 10/1974 | Borggren et al. |
| D247,216 | S | 2/1978 | Mathews |
| 4,105,244 | A | 8/1978 | Colby |
| 4,784,436 | A | 11/1988 | Sutherland |
| 4,819,958 | A | 4/1989 | Perego |
| 4,826,241 | A | 5/1989 | Barras |
| 4,898,421 | A | 2/1990 | Brunn |
| 5,137,328 | A | 8/1992 | Smith et al. |
| 5,294,171 | A | 3/1994 | Horng |

(Continued)

FOREIGN PATENT DOCUMENTS

| | | | |
|---|---|---|---|
| CN | 2456550 | Y | 10/2001 |
| CN | 2836608 | Y | 11/2006 |

(Continued)

OTHER PUBLICATIONS tommybahama.com, "Tommy Bahama Sunset Stripe Deluxe Backpack Beach Chair", Tommy Bahama, retrieved on Mar. 26, 2025 from <https://www.tommybahama.com/en/Tommy-Bahama-Sunset-Stripe-Deluxe-Backpack-Beach-Chair/p/SC537TB2474U-199,> 10 pages.

(Continued)

*Primary Examiner* — Philip J Bonzell
(74) *Attorney, Agent, or Firm* — Banner & Witcoff, Ltd.

(57) ABSTRACT

A portable chair may include a first front leg, a first back leg pivotally connected to the first front leg, a second front leg, a second back leg pivotally connected to the second front leg, a seat support assembly and a seat assembly. The seat support assembly is connected to the first front leg and the first back leg. The seat assembly may releasably connect to the seat support assembly. The seat support assembly may include a front seat support pivotally connected to the first front leg, a rear seat support pivotally connected to the first back leg, and a strut extending between the first front seat support and the first rear seat support. The seat assembly may include a pair of seat side rails and a seat fabric extending between the pair of seat side rails. The portable chair may have a use configuration and a folded configuration.

19 Claims, 9 Drawing Sheets

(56) References Cited

U.S. PATENT DOCUMENTS 5,318,348 A 6/1994 Hess
5,662,383 A 9/1997 Hand
5,707,105 A 1/1998 Liu
5,716,101 A 2/1998 Frinier et al.
5,762,403 A 6/1998 Robinson
5,855,409 A 1/1999 Tseng
5,911,478 A 6/1999 Goodman
D417,561 S 12/1999 Liu
6,056,354 A 5/2000 Tseng
6,095,596 A 8/2000 Chen
D438,394 S 3/2001 Tseng
6,206,462 B1 3/2001 Huang
6,364,409 B1 4/2002 Saul et al.
6,471,287 B1 10/2002 Liu
6,502,899 B2 1/2003 Tseng
6,517,151 B2 2/2003 Liu
6,536,079 B2 3/2003 Hill
6,536,839 B2 3/2003 Liu
6,550,857 B1 4/2003 Canton
6,560,827 B1 5/2003 Gross
6,585,323 B2 7/2003 Gaylord et al.
6,595,582 B1 7/2003 Liu
6,644,732 B1 11/2003 Lin
6,692,068 B1 * 2/2004 Tang ..... A47C 1/03244 297/16.2
6,739,652 B2 5/2004 Welsh
6,764,132 B1 7/2004 Gaertner
6,779,849 B1 8/2004 Harper et al.
6,824,210 B2 11/2004 Zheng
D507,424 S 7/2005 Rogasis
D513,896 S 1/2006 Krake
7,040,834 B2 5/2006 Nardi
7,125,022 B2 10/2006 Medina
7,125,081 B2 10/2006 Church et al.
D532,621 S 11/2006 Lin
7,185,948 B2 3/2007 Liu
7,192,091 B1 3/2007 Ping Sheng
7,273,249 B1 9/2007 Tseng
D555,371 S 11/2007 Le Gal
7,331,628 B2 2/2008 Lin
D571,115 S 6/2008 Cohen
7,481,495 B2 1/2009 Wang
7,490,895 B2 2/2009 Yeh
D598,276 S 8/2009 Rhee
7,740,320 B2 6/2010 Chiang
D632,950 S 2/2011 McGreevy et al.
8,061,766 B2 11/2011 Miller
D651,010 S 12/2011 Cohen
8,162,389 B2 4/2012 Cohen
8,197,000 B1 6/2012 Cohen
8,251,442 B2 8/2012 Grace
8,317,270 B2 11/2012 Tseng
8,403,421 B2 3/2013 Wang
8,419,134 B1 4/2013 Yuan
D715,624 S 10/2014 Thompson et al.
8,919,884 B2 12/2014 Lee
D720,984 S 1/2015 Privitera et al.
9,044,092 B1 6/2015 Lee
9,089,220 B2 7/2015 Weng
9,126,519 B2 9/2015 Uebelacker
9,161,629 B2 10/2015 Huang
9,173,495 B2 11/2015 Goldszer
9,282,824 B2 3/2016 Grace
9,370,247 B1 6/2016 Caldwell
9,451,829 B2 9/2016 Chen
9,510,691 B1 12/2016 Lee
9,808,091 B1 11/2017 Goldszer
D804,232 S 12/2017 Oliphant et al.
D804,880 S 12/2017 Oliphant et al.
9,839,566 B2 12/2017 Yentzer et al.
9,877,587 B2 1/2018 Grace
10,098,467 B2 10/2018 Bayiokos
D839,721 S 2/2019 Downey et al.
10,194,749 B1 * 2/2019 Doolan ..... A47C 5/06
D843,150 S 3/2019 Doolan et al.
D843,151 S 3/2019 Doolan et al.
D843,152 S 3/2019 Doolan et al.
10,231,550 B2 3/2019 Weirun
10,238,214 B1 3/2019 Haythornthwaite
D844,338 S 4/2019 Franks et al.
D848,756 S 5/2019 Ren
D849,437 S 5/2019 Yang
D850,135 S 6/2019 Yang
10,681,992 B2 6/2020 Wang
10,722,034 B2 7/2020 Winterhalter et al.
D902,617 S 11/2020 Sullivan et al.
10,881,211 B1 1/2021 Al-Salloom
D911,730 S 3/2021 Doolan et al.
D911,731 S 3/2021 Sullivan et al.
10,932,578 B1 3/2021 Lin
D929,758 S 9/2021 Hutchinson et al.
D930,377 S 9/2021 Hutchinson
11,109,682 B2 9/2021 Yang
11,134,792 B2 10/2021 Case et al.
11,172,765 B1 11/2021 Zurian
11,241,097 B2 * 2/2022 Cieszko ..... A47C 4/46
11,259,639 B2 3/2022 Wilcox
11,330,907 B1 5/2022 Frisch
D955,132 S 6/2022 Sullivan et al.
11,426,002 B2 8/2022 Garrison
D976,601 S 1/2023 Fusco et al.
11,659,930 B1 5/2023 Chen et al.
11,744,370 B2 9/2023 Winterhalter et al.
11,744,372 B2 9/2023 Kawaguchi
12,144,430 B2 * 11/2024 Cieszko ..... A47C 1/03244
2002/0171268 A1 11/2002 Liu
2002/0175540 A1 11/2002 Liu
2003/0025361 A1 2/2003 Liu
2003/0160495 A1 8/2003 Tarnay et al.
2005/0140182 A1 6/2005 Tsang
2006/0001242 A1 1/2006 Fulks
2006/0163934 A1 7/2006 Chen
2009/0179464 A1 7/2009 Wright
2012/0175917 A1 7/2012 Chen
2013/0134762 A1 5/2013 Hsiao
2015/0054318 A1 2/2015 Howard
2015/0061348 A1 3/2015 Shen
2015/0084381 A1 3/2015 Nelson
2017/0055711 A1 3/2017 Goldszer
2017/0105892 A1 4/2017 Epstein
2018/0338623 A1 * 11/2018 Winterhalter ..... A47C 4/10
2019/0045908 A1 2/2019 Zhu et al.
2019/0082846 A1 3/2019 Grace
2019/0374033 A1 12/2019 Grace
2020/0383481 A1 * 12/2020 Cieszko ..... A47C 4/46
2022/0039555 A1 2/2022 Fritze
2022/0167746 A1 * 6/2022 Cieszko ..... A47C 1/0307
2022/0265050 A1 8/2022 Wu
2023/0087726 A1 3/2023 Mullet et al.
2023/0225514 A1 7/2023 Hsu Besner et al.

FOREIGN PATENT DOCUMENTS

CN 3587682 D 12/2006
CN 201119650 Y 9/2008
CN 301132539 2/2010
CN 301488297 S 3/2011
CN 202035773 U 11/2011
CN 301724838 11/2011
CN 301724841 11/2011
CN 301724856 11/2011
CN 301765817 11/2011
CN 301782003 1/2012
CN 301836489 2/2012
CN 302286012 1/2013
CN 302294834 1/2013
CN 302337389 3/2013
CN 302388829 4/2013
CN 302399200 4/2013
CN 202959547 U 6/2013
CN 302684929 12/2013
CN 302733200 2/2014
CN 302733205 S 2/2014
CN 303501418 12/2015

(56) References Cited

FOREIGN PATENT DOCUMENTS

| | | | |
|---|---|---|---|
| CN | 205250945 | U | 5/2016 |
| CN | 303673854 | | 5/2016 |
| CN | 303715019 | | 6/2016 |
| CN | 205410425 | U | 8/2016 |
| CN | 205432888 | U | 8/2016 |
| CN | 106617832 | A | 5/2017 |
| CN | 304259396 | | 8/2017 |
| CN | 304366086 | | 11/2017 |
| CN | 304366089 | | 11/2017 |
| CN | 107440374 | A | 12/2017 |
| CN | 304470127 | | 1/2018 |
| CN | 304479478 | | 1/2018 |
| CN | 304785977 | S | 8/2018 |
| CN | 304915867 | | 11/2018 |
| CN | 304995356 | | 1/2019 |
| CN | 305117619 | | 4/2019 |
| CN | 305184743 | | 5/2019 |
| CN | 305192101 | | 6/2019 |
| CN | 305283367 | S | 8/2019 |
| CN | 305294546 | S | 8/2019 |
| CN | 209563815 | U | 11/2019 |
| CN | 305410948 | | 11/2019 |
| CN | 305665643 | | 3/2020 |
| CN | 305665814 | | 3/2020 |
| CN | 305720141 | | 4/2020 |
| CN | 111109911 | A | 5/2020 |
| CN | 305754282 | | 5/2020 |
| CN | 111436785 | A | 7/2020 |
| CN | 305909030 | S | 7/2020 |
| CN | 305916756 | | 7/2020 |
| CN | 306305745 | | 7/2020 |
| CN | 305992763 | | 8/2020 |
| CN | 306171557 | | 11/2020 |
| CN | 306185745 | | 11/2020 |
| CN | 306356199 | | 3/2021 |
| CN | 306362131 | | 3/2021 |
| CN | 306517482 | | 5/2021 |
| CN | 306556022 | S | 5/2021 |
| CN | 306642408 | S | 6/2021 |
| CN | 306657600 | S | 7/2021 |
| CN | 306700842 | S | 7/2021 |
| CN | 306844273 | S | 9/2021 |
| CN | 306932208 | S | 11/2021 |
| CN | 306932209 | S | 11/2021 |
| CN | 307030848 | S | 12/2021 |
| CN | 307030918 | S | 12/2021 |
| CN | 307104457 | S | 2/2022 |
| CN | 307185713 | S | 3/2022 |
| CN | 307198593 | S | 3/2022 |
| CN | 307216677 | S | 4/2022 |
| CN | 307216678 | S | 4/2022 |
| CN | 307432880 | S | 7/2022 |
| CN | 307439656 | S | 7/2022 |
| CN | 307445627 | S | 7/2022 |
| CN | 307461203 | S | 7/2022 |
| CN | 307484391 | S | 8/2022 |
| CN | 307507773 | S | 8/2022 |
| CN | 307540639 | S | 9/2022 |
| CN | 307540691 | S | 9/2022 |
| CN | 307560256 | S | 9/2022 |
| CN | 307577426 | S | 10/2022 |
| CN | 307843921 | S | 2/2023 |
| CN | 307864772 | S | 2/2023 |
| CN | 307893082 | S | 3/2023 |
| CN | 307951936 | S | 4/2023 |
| CN | 307951979 | S | 4/2023 |
| CN | 307983157 | S | 4/2023 |
| CN | 219331126 | U | 7/2023 |
| CN | 219374193 | U | 7/2023 |
| CN | 219500704 | U | 8/2023 |
| CN | 308159746 | S | 8/2023 |
| CN | 308164862 | S | 8/2023 |
| CN | 219613408 | U | 9/2023 |
| CN | 219661272 | U | 9/2023 |
| CN | 219699435 | U | 9/2023 |
| CN | 116421015 | B | 11/2023 |
| DE | 102016122681 | A1 | 5/2018 |
| DE | 202023102818 | U1 | 6/2023 |
| EM | 0025235220001 | D | 8/2014 |
| EM | 0025239360001 | D | 8/2014 |
| EM | 0025244390001 | | 8/2014 |
| EM | 0033711780001 | D | 9/2016 |
| EM | 0074185120001 | D | 12/2019 |
| EM | 0077065280002 | D | 2/2020 |
| EM | 0150095870001 | | 1/2023 |
| EP | 0399893 | A1 | 11/1990 |
| EP | 0976347 | | 2/2000 |
| EP | 1234531 | A3 | 9/2003 |
| EP | 1127516 | B1 | 10/2004 |
| EP | 2108284 | A1 | 10/2009 |
| EP | 2820975 | A1 | 1/2015 |
| EP | 4248802 | A1 | 9/2023 |
| FK | 3737264 | B1 | 9/2023 |
| GB | 383467 | A | 11/1932 |
| JP | 2012081056 | A | 4/2012 |
| JP | 2021062019 | A | 4/2021 |
| JP | 7251041 | B1 | 4/2023 |
| JP | 3242718 | U | 7/2023 |
| WO | 2019165090 | A1 | 8/2019 |

OTHER PUBLICATIONS getsunflow.com, "The Original Chair", Sunflow, retrieved on Mar. 26, 2025 from <https://getsunflow.com/products/the-original-chair?variant=47890485707027,> 7 pages.

parkitmovement.com, "Voyager", Parkit, retrieved on Mar. 26, 2025 from https://parkitmovement.com/products/the-voyager-chair?variant=41068697747529, 4 pages.

ostrichchairs.com, "Ostrich Deluxe 3N1 Chair with Added Padding", Ostrich, retrieved on Mar. 26, 2025 from <https://ostrichchairs.com/products/ostrich-deluxe-3n1-beach-chair-added-padding-and-lumbar>, 2 pages.

nemoequipment.com, "Stargaze Reclining Camp Chair", Nemo, retrieved on Mar. 26, 2025 from <https://www.nemoequipment.com/products/stargaze-reclining-camp-chair?variant=42692252074157>, 9 pages.

snowpeak.com, "Low Beach Chair", Snow Peak, retrieved on Mar. 26, 2025 from <https://www.snowpeak.com/products/low-beach-chair?_pos=1&_sid=89a1f5261&_ss=r&variant=32400816308268>, 9 pages.

strongbackchair.com, "Strongback Low G Recliner", Strongback, retrieved on Mar. 26, 2025 from <https://www.strongbackchair.com/collections/low-g-recliner/products/low-g-recliner-green-grey-mesh?variant=43096395055157>, 5 pages.

gcioutdoor.com, "Pod Rocker", Front Row Seat to Life, retrieved on Mar. 26, 2025 from <https://gcioutdoor.com/products/pod-rocker?variant=40841598075038>, 3 pages.

frontrunneroutfitters.com, "Expander Camping Chair", Front Runner, retrieved on Mar. 26, 2025 from https://www.frontrunneroutfitters.com/en/us/front-runner-expander-chair.html, 3 pages.

rei.com, "Freeform Zero Gravity Lounger", GCI Outdoor, retrieved on Mar. 26, 2025 from https://www.rei.com/product/170998/gci-outdoor-freeform-zero-gravity-lounger, 10 pages.

Jul. 17, 2025—(WO) International Search Report & Written Opinion—PCT/US25/17843.

gcioutdoor.com, "Rockers", GCI, retrieved on Mar. 13, 2026 from <https://gcioutdoor.com/collections/rockers,> 7 pages.

snowpeak.com, "Luxury Low Beach Chair", Snow Peak, retrieved on Mar. 13, 2026 from <https://www.snowpeak.com/products/gray-low-beach-chair-short?ab=0&_fd=0&_sc=1&srsltid=AfmBOopOIR1sSQLzf0wWCtSRF5JxbQVHcbTDNnMw9CUaiZDSLpHFrjOA&variant=32 401843093548,> 9 pages.

kohls.com, "Hurley Backpack Beach Chair", Hurley, retrieved on Mar. 13, 2026 from <https://www.kohls.com/product/prd-7418382/hurley-backpack-beach-chair.jsp,> 6 pages.

amazon.com, "RIO Beach Big Boy 4-Position 13" High Seat Backpack Beach or Camping Folding Chair", Rio, retrieved on Mar.

(56) References Cited

OTHER PUBLICATIONS 13, 2026 from <https://www.amazon.com/Beach-4-Position-Backpack-Camping-Folding/dp/B0757LP6FY?th=1,> 12 pages.

* cited by examiner

PORTABLE CHAIR

FIELD OF THE INVENTION

This disclosure relates to portable chairs. More specifically, aspects of this disclosure relate to portable and collapsible chairs that are able to be adjusted for multiple seating positions.

BACKGROUND

Portable chairs are commonly used during events and activities where seating is desirable, but not always provided, such as tailgating, camping, going to the beach, and other outdoor activities. In most cases, the chairs may be uncomfortable and have limited ability to adjust the seating position. Additionally, the chairs may have poor durability reducing the long-term viability of the chair. Accordingly, overall user satisfaction with some portable chairs is low and the frequency of replacement is high.

BRIEF SUMMARY

The following presents a simplified summary of various aspects described herein. This summary is not an extensive overview, and is not intended to identify key or critical elements or to delineate the scope of the claims. The following summary merely presents some concepts in a simplified form as an introductory prelude to the more detailed description provided below.

This disclosure may relate to a portable chair that comprises: (a) a first front leg, (b) a first back leg pivotally connected to the first front leg, (c) a second front leg, (d) a second back leg pivotally connected to the second front leg, and (e) a first seat support assembly connected to the first front leg and the first back leg. The first seat support assembly may include a first front seat support pivotally connected to the first front leg, a first rear seat support pivotally connected to the first back leg, and a first strut extending between the first front seat support and the first rear seat support. A seat assembly may be releasably connected to the first seat support assembly, where the seat assembly comprises: (a) a pair of seat side rails, (b) a seat back rail extending between the pair of seat side rails, and (c) a seat fabric extending between the pair of seat side rails. A first seat side rail of the pair of seat side rails may be supported by the first front seat support and the first rear seat support. The portable chair may also have a use configuration and a folded configuration. The first strut may be located inboard of the first seat side rail. The first strut may be substantially parallel to the first seat side rail. The first front seat support may include a support surface having a concave shape that supports the first seat side rail. The first front seat support may also include an aperture below the support surface that receives a front pivot, where the front pivot pivotally connects the first front seat support and the first front leg. The first rear seat support may include a support surface that has a concave shape that supports the first seat side rail. The first rear seat support may include an aperture that extends through the support surface and receives a rear pivot, where the rear pivot may pivotally connect the first rear seat support and the first back leg. The portable chair may further include a back assembly pivotally connected to the first back leg and the second back leg, the back assembly comprising: a pair of back side rails, a back fabric extending between the pair of back side rails, a first armrest pivotally connected to a first back side rail of the pair of back side rails, and a second armrest pivotally connected to a second back side rail of the pair of back side rails. A first guide may be pivotally connected to the first front leg and the first back leg, and a second guide may be pivotally connected to the second front leg and the second back leg. The first armrest is movably connected with the first guide, and the second armrest is movably connected with the second guide. When the portable chair is in the use configuration, the portable chair may have an upright position and a reclined position. The first armrest may include a set of internal receivers that receive the first guide such that when the first guide is in a rearward most receiver of the set of internal receivers, the portable chair is in the upright position. In addition, when the first guide is in a receiver of the set of receivers located forward of the rearward most receiver, the portable chair is in a reclined position. The back assembly may be releasably connected to a pair of backrest couplers, where an upper portion of a first backrest coupler of the pair of backrest couplers is inserted into an opening of at a bottom of a first back side rail. The first back side rail may be secured to the first backrest coupler by an armrest pivot that is also pivotally connected to the first armrest.

Other aspects of this disclosure may relate to a portable chair comprising: (a) a chair frame including: (1) a first front leg, (2) a second front leg, (3) a first back leg connected to the first front leg, (4) a second back leg connected to the second front leg, (5) a first seat support assembly including: a first front seat support including a first concave surface and a first rear seat support including a first pin, and (6) a second seat support assembly including: a second front seat support including a second concave surface and a second rear seat support including a second pin, and (b) a seat assembly including: (1) a first seat side rail including a first aperture and a first convex portion, where the first aperture configured to releasably receive the first pin, and where the first concave surface is configured to releasably receive and support the first convex portion, (2) a second seat side rail including a second aperture and a second convex portion, where the second aperture configured to releasably receive the second pin, and where the second concave surface is configured to releasably receive and support the second convex portion, and (3) seat fabric extending between the first seat side rail and the second seat side rail. The chair frame may further comprise a back assembly operably connected to the first back leg and the second back leg. The back assembly may include: (a) a first back side rail, (b) a second back side rail, and (c) back fabric extending between the first back side rail and the second back side rail. A first armrest may be connected to the first back side rail, and a second armrest may be connected to the second back side rail. A first guide may pivotally connect the first front leg and the first back leg, and a second guide may pivotally connect the second front leg and the second back leg. The first armrest may be movably connected with the first guide, and the second armrest is movably connected with the second guide. A hook may be pivotally connected to the first armrest, where the hook releasably engages a portion of the chair frame to prevent the portable chair from unfolding when the portable chair is in a folded configuration. The first back side rail may be releasably connected to a first backrest coupler and the second back side rail is releasably connected to a second backrest coupler. The first backrest coupler may be operably connected to the first back leg and the second backrest coupler is operably connected to the second back leg. An upper protrusion of the first backrest coupler may be inserted into a bottom of the first back side rail. The chair frame may further comprise a first strut extending between the first front seat support and the first rear seat support, and a second strut extending between the second front seat support and the second rear seat support.

Still other aspects of this disclosure may relate to a portable chair comprising: (a) a first front leg, (b) a first back leg pivotally connected to the first front leg by a first guide, (c) a second front leg, and (d) a second back leg pivotally connected to the second front leg by a second guide. The portable chair may further comprise a back assembly including: (a) a first back side rail including a first bottom opening, (b) a second back side rail including a second bottom opening, and (c) back fabric extending between the first back side rails and the second back side rail. A first backrest coupler may be operatively coupled to the first back leg, where the first backrest coupler includes a first protrusion configured to be received in the first bottom opening of the first back side rail to removably couple the first back side rail to the first back leg, and a second backrest coupler may be operatively coupled to the second back leg, where the second backrest coupler includes a second protrusion configured to be received in the second bottom opening of the second back side rail to removably couple the second back side rail to the second back leg. A first armrest may be pivotally connected to the first back side rail with a first removable armrest pivot, where the first armrest is further connected to the first guide such that the first armrest is retained on the first guide when the first removable armrest pivot is removed, and a second armrest may also be pivotally connected to the second back side rail with a second removable armrest pivot, where the second armrest is further connected to the second guide such that the second armrest is retained on the second guide when the second removable armrest pivot is removed.

DETAILED DESCRIPTION

Figure 1:
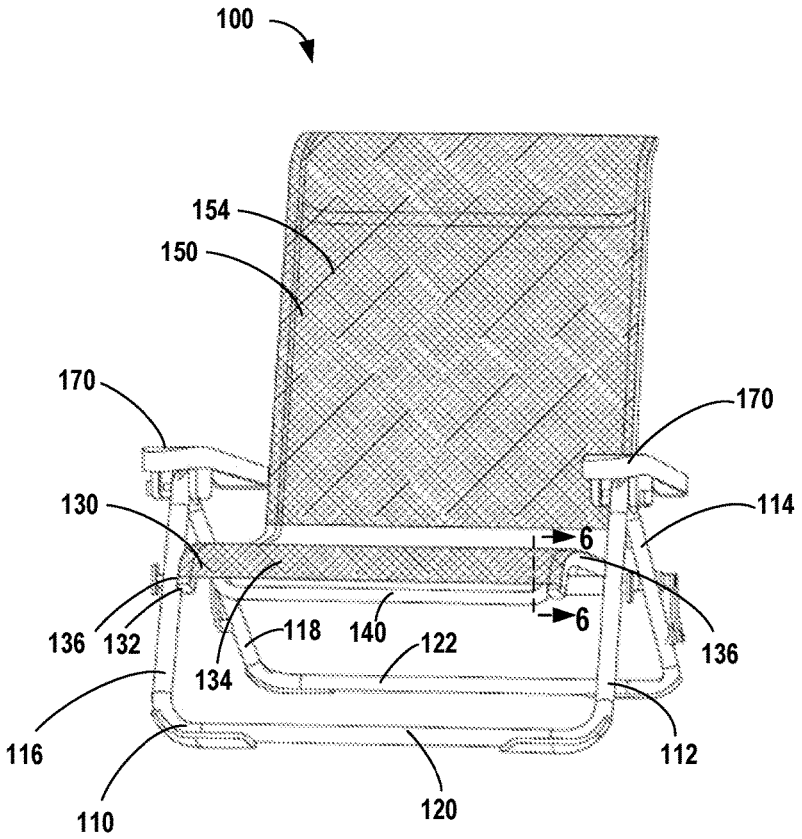
FIG. 1 depicts a top, right front perspective view of the portable chair in a use configuration in an upright position according to aspects disclosed herein.

In the following description of various example structures, reference is made to the accompanying drawings, which form a part hereof, and in which are shown by way of illustration various example devices, systems, and environments in which aspects of the disclosure may be practiced. It is to be understood that other specific arrangements of parts, example devices, systems, and environments may be utilized and structural and functional modifications may be made without departing from the scope of the present disclosure.

Also, while the terms "top," "bottom," "front," "back," "side," "rear," and the like may be used in this specification to describe various example features and elements of the invention, these terms are used herein as a matter of convenience (e.g., based on the example orientations shown in the figures or the orientation during typical use). Additionally, the term "plurality," as used herein, indicates any number greater than one, either disjunctively or conjunctively, as necessary, up to an infinite number.

The terms "connect," "couple", or "attach" as used herein indicates that components, surfaces, or features and the like may be directly or indirectly (i.e. through an intermediary) joined, linked, or attached. In addition, "pivotally connected" as used herein, indicates that the components or features may be directly or indirectly coupled together such that the components can rotate relative to each other while still being coupled together either directly or indirectly. Examples of a "pivotally connected" joint may include a pin inserted into an opening arranged in each of the components to "pivotally connect" the components.

Nothing in this specification should be construed as requiring a specific three dimensional orientation of structures in order to fall within the scope of this invention. The reader is advised that the attached drawings are not necessarily drawn to scale.

Generally, this disclosure relates to a portable chair that has an unfolded or use configuration and a folded or transport configuration. The portable chair may be easily folded and carried by a user to any location and then easily be unfolded to provide comfortable seating. The portable chair may also have multiple seating positions from an upright position to a plurality of reclined positions (i.e., in a reclined position, the angle formed between a back assembly and a seat assembly is greater than when the portable chair is in an upright position).

As shown in FIGS. 1-5, the portable chair 100 may comprise a chair frame 110, a seat assembly 130, and a back assembly 150. The seat assembly 130 and the back assembly 150 may be releasably connected to the chair frame 110. By having a releasable seat assembly 130 and back assembly 150, if a seat assembly 130 and/or a back assembly 150 is damaged, the seat assembly 130 and/or the back assembly 150 may be replaced with another one without having to replace the entire chair.

The chair frame 110 may include a first front leg 112, a first back leg 114 pivotally connected to the first front leg 112, a second front leg 116, and a second back leg 118 pivotally connected to the second front leg 116. The first front leg 112 may be connected to the second front leg 116 by a front sled 120. Similarly, the first back leg 114 may be connected to the second back leg 118 by a back sled 122. A first guide 126 may pivotally connect the first front leg 112 and the first back leg 114, and a second guide 126 may pivotally connect the second front leg 116 and the second back leg 118. The portable chair 100 may also include a pair of armrests 170 that are each pivotally connected to the back assembly 150 and are also each movably connected to one of the guides 126. Each armrest 170 may be pivotally connected to the back assembly 150 by a removable armrest pivot 178 (e.g., pin). Each armrest 170 may be on opposite sides of the chair frame 110, such that one armrest 170 is movably connected to the first guide 126 and the other armrest 170 is movably connected to the second guide 126. In addition, the chair 100 may include a mount 230 on one or both of the front legs 112, 116 that may be used to secure an external cupholder or other accessory (not shown).

As best shown in FIGS. 6-16, the chair frame 110 may include a pair of seat support assemblies 180 that releasably connect to and secure the seat assembly 130 to the chair frame 110. The seat assembly 130 may comprise a seat frame 132 and a seat fabric 134 that is connected to the seat frame 132. The seat frame 132 may include a pair of seat side rails 136 arranged opposite each other where the seat fabric 134 extends between the pair of seat side rails 136. Each seat support assembly 180 may be pivotally connected to either the first front leg 112 and the first back leg 114 or the second front leg 116 and the second back leg 118. The seat assembly 130 may be releasably connected to the pair of seat support assemblies 180. The seat support assemblies 180 may maintain the rigidity and structure of the chair frame 110 when the seat assembly 130 is removed. Thus, the seat assembly 130 may be removably connected without negatively effecting the structural integrity of the chair frame 110.

Figure 7:
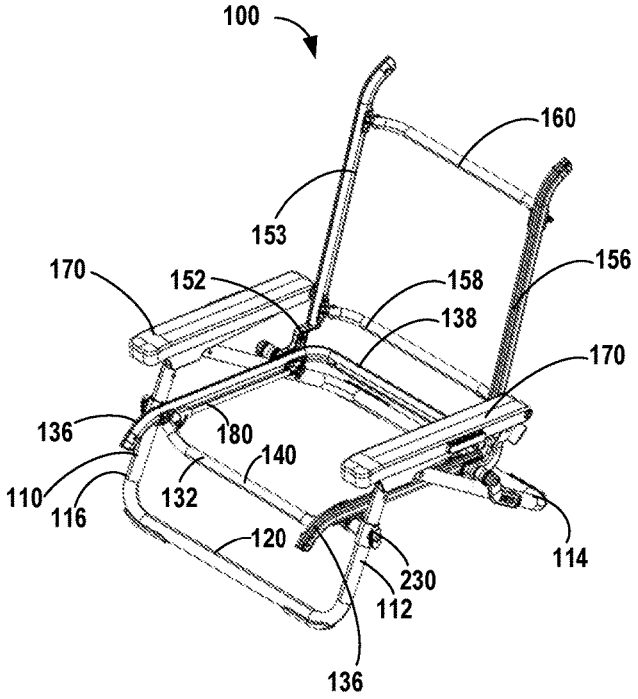
FIG. 7 depicts a top, front perspective view of the portable chair of FIG. 4 with the fabric removed for clarity according to aspects disclosed herein.
Figure 8:
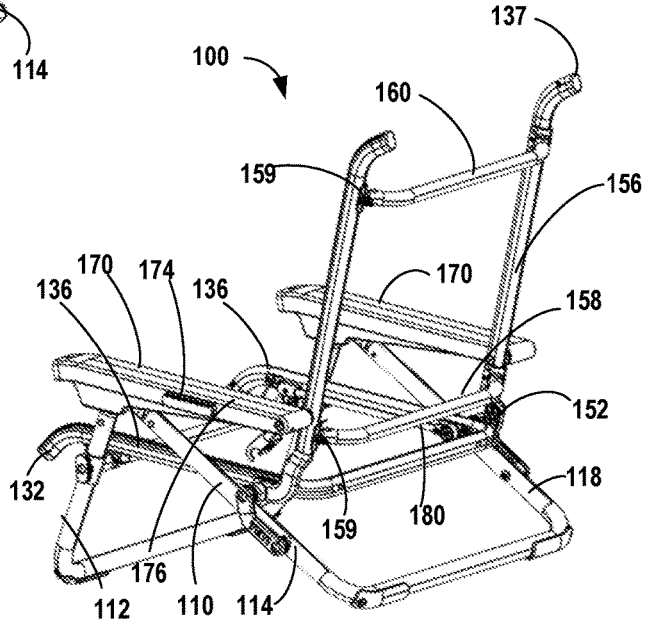
FIG. 8 depicts a top, rear perspective view of the portable chair of FIG. 7 according to aspects disclosed herein.
Figure 9:
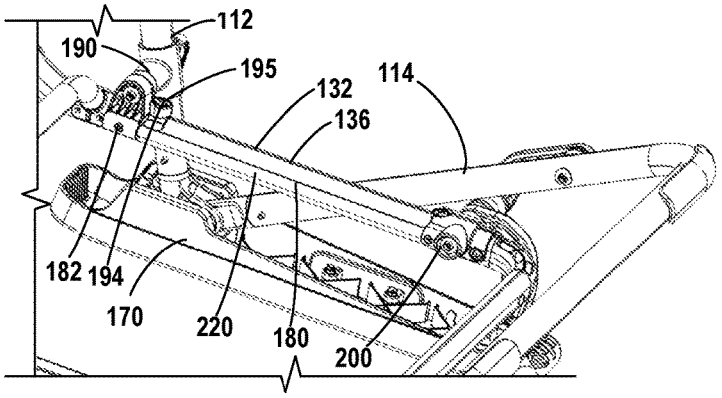
FIG. 9 depicts a bottom, rear perspective view of the portable chair of FIG. 7 according to aspects disclosed herein.

FIGS. 7-9 illustrate the chair 100 with the fabrics 134, 154 removed for clarity of the seat support assemblies 180. Each seat support assembly 180 may comprise a front seat support 182, a rear seat support 200, and a strut 220. Each strut 220 may extend between and connect to a front seat support 182 and a rear seat support 200. Each seat support assembly 180 may be pivotally connected to their respective front legs 112, 116 and the respective back legs 114, 118. For instance, a first seat support assembly 180 may be pivotally connected to the first front leg 112 and back leg, 114 while a second seat support assembly 180 may be pivotally connected to the second front and the back legs 114, 118. The front seat supports 182 may be pivotally connected to the respective front legs 112, 116 with respective front pivots 196 (e.g., pins), and the rear seat supports 200 may be pivotally connected to the respective back legs 116, 118 with respective rear pivots 208 (e.g., pins).

When the seat assembly 130 is connected to the pair of seat support assemblies 180, each strut 220 of each seat support assembly 180 may be located inboard (i.e., toward a center plane that runs from a forward end 104 to a rearward end 106 of the portable chair 100) from the corresponding seat side rail 136. Alternatively, the seat support assembly 180 may be arranged such that the strut 220 is located outboard or below the corresponding seat side rail 136. The seat assembly 130 may be releasably connected to each seat support assembly 180 using a mechanical fastener 195. In some examples, the seat assembly 130 may be releasably secured to each seat support assembly 180 with only a single mechanical fastener 195. In the illustrated example, a single fastener 195 releasably connects each seat side rail 136 of the seat frame 132 to a corresponding seat support assembly 180. The fastener 195 may releasably connect a front seat support 182 to a seat side rail 136 of the seat frame 132. The front seat support 182 may include an aperture 194 that receives the mechanical fastener 195 and connects to a corresponding receiver on the seat side rail 136 as shown in FIG. 9. In the illustrated example, the receiver on the seat side rail 136 may be located on a bottom surface of the seat side rail 136, however, the aperture 194 and corresponding receiver on seat side rail 136 may be on a top surface, side surface, or any appropriate location. Thus, by removing only two fasteners 195 (i.e., a single fastener 195 per seat side rail 136), a user may easily replace the seat assembly 130 if desired or necessary.

Figure 10:
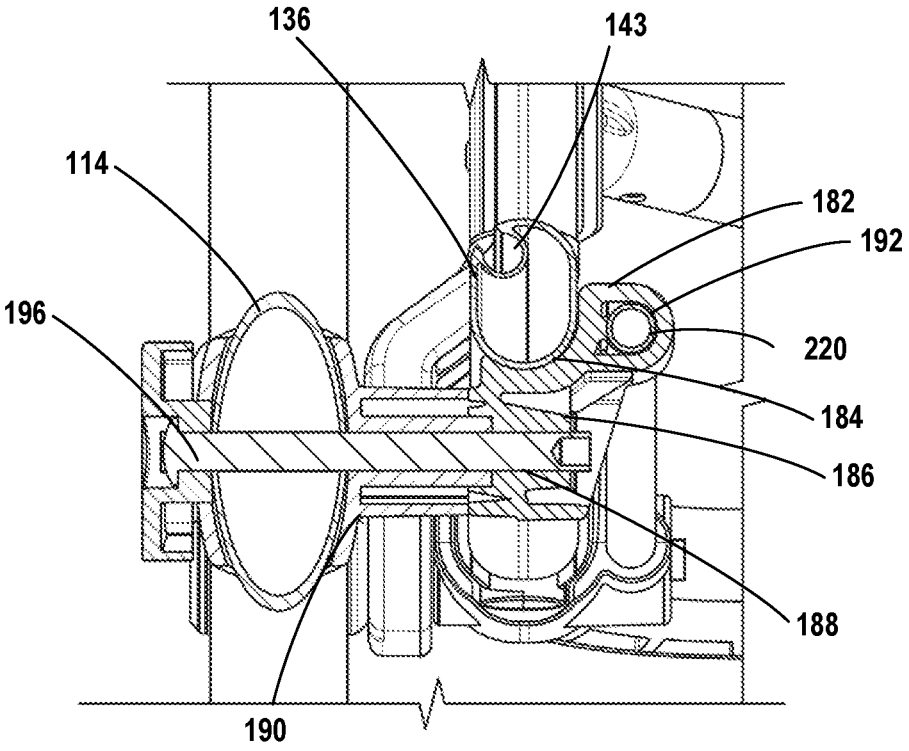
FIG. 10 depicts an enlarged partial cross-sectional view of the portable chair of FIG. 1 along line 10-10 according to aspects disclosed herein.
Figure 12:
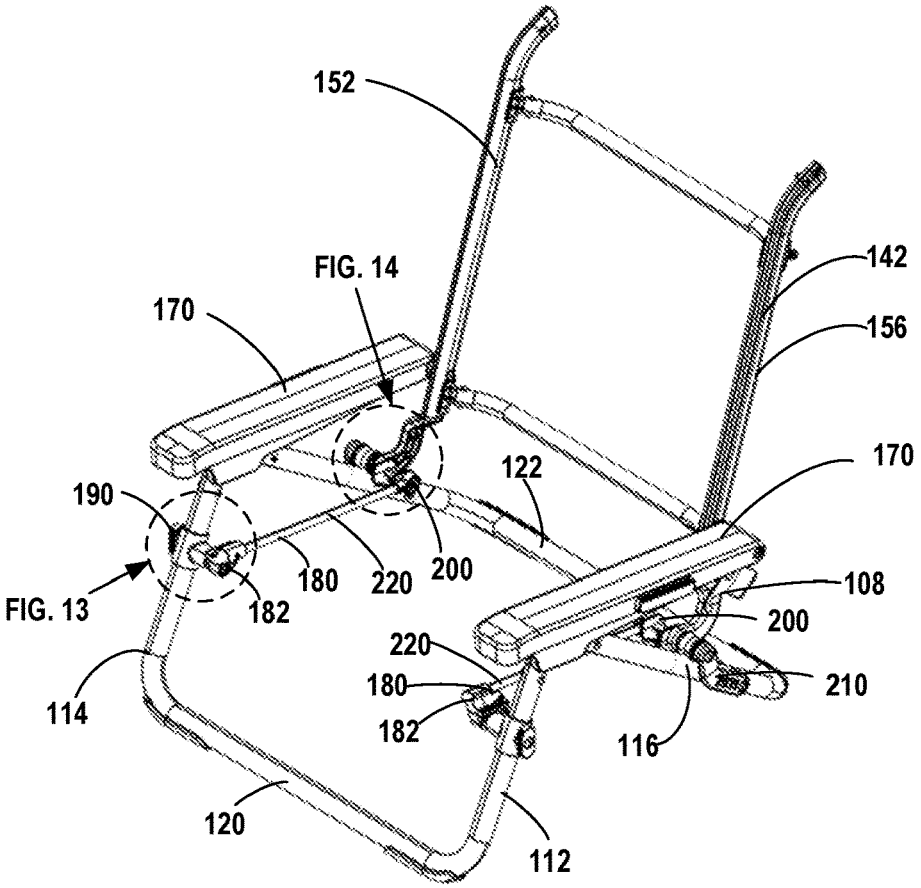
FIG. 12 depicts a top, front perspective view of the portable chair of FIG. 1 with the seat assembly removed for clarity according to aspects disclosed herein.
Figure 13:
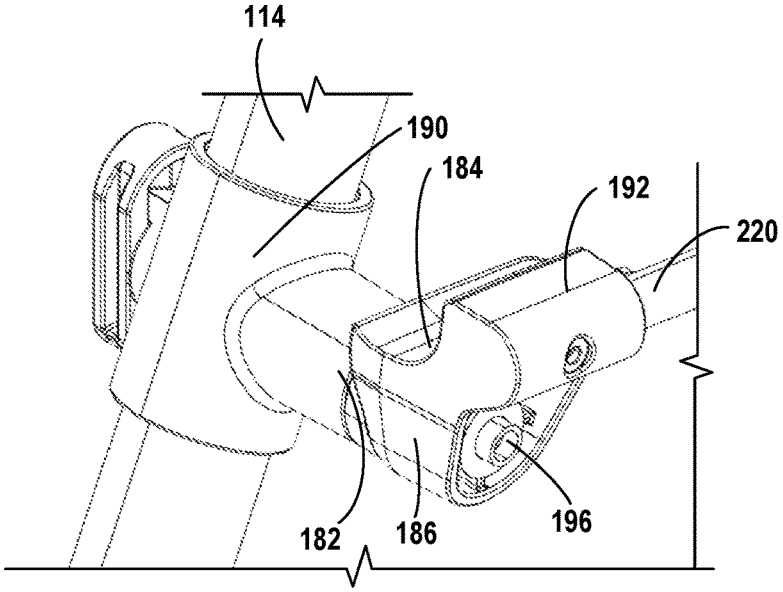
FIG. 13 depicts an enlarged partial perspective view of the portable chair of FIG. 12 according to aspects disclosed herein.

As shown in FIGS. 10 and 12-13, each front seat support 182 may include a support surface 184 that supports and contacts the respective seat side rail 136. The support surface 184 may have a concave shape and may also have a substantially vertical portion that confronts a side surface of the respective seat side rail 136. Each seat side rail 136 may have a convex portion. For instance, the top and bottom surfaces of each seat side rail 136 may be convex connected by substantially planar side surfaces. While in other instances, each seat side rail 136 may have a rounded, elliptical, or generally rectangular shape. The convex portion of each seat side rail 136 may be releasably received in the concave support surface 184 of the front seat support 182.

In addition, the front seat support 182 may include a connection portion 186 that includes an aperture 188 that receives a front pivot 196 as shown in FIG. 10. The aperture 188 may be positioned below the support surface 184. The connection portion 186 may include an engagement member 190 that engages the respective front leg 112, 116. The front seat support 182 may also include a receiver 192 inboard of the support surface 184, where the receiver 192 comprises a cavity that receives a forward end of the strut 220.

Figure 11:
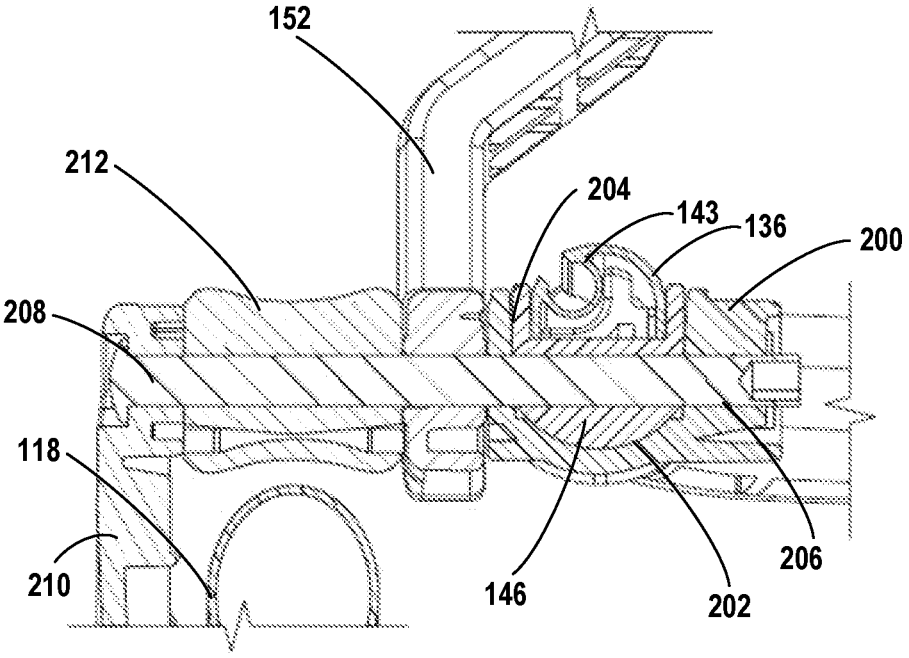
FIG. 11 depicts an enlarged partial cross-sectional view of the portable chair of FIG. 1 along line 11-11 according to aspects disclosed herein.
Figure 14:
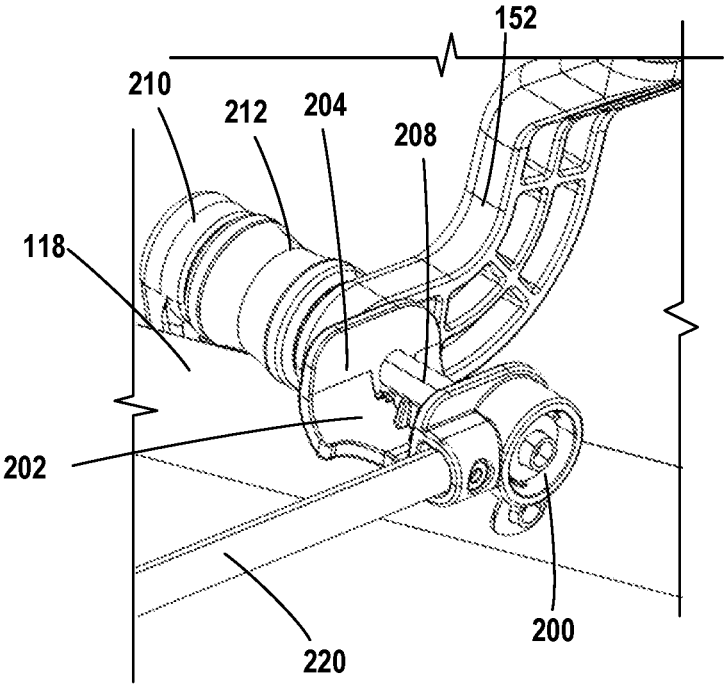
FIG. 14 depicts an enlarged partial perspective view of the portable chair of FIG. 12 according to aspects disclosed herein.

As best shown in FIGS. 11-12 and 14, each rear seat support 200 may include a support surface 202 that supports and contacts the respective seat side rail 136. The support surface 202 may have a concave portion and may also have a pair of substantially vertical portions 204 that each confront side surfaces of the respective seat side rails 136. Similar to the front seat supports 182, a convex portion of the seat side rails 136 may be releasably received in the concave support surface 202 of the rear seat support 200. In addition, the rear seat support 200 may include an aperture 206 that extends through the vertical portions 204 that receives a rear pivot 208. The rear pivot 208 may connect the rear seat support 200 to a connecting member 210 that is pivotally connected to the back legs 114, 118. The connecting member 210 may rotate when the portable chair 100 is moved from an unfolded or use configuration to a folded configuration. In addition, a backrest coupler 152 may be pivotally connected with the rear seat support 200 and the rear pivot 208 as shown in FIGS. 11 and 14. In addition, a roller 212 may be rotationally connected with the pivot 208 that may engage a respective back leg 114, 118 when the portable chair 100 is moved between folded and unfolded configurations. The roller 212 may be positioned between the rear seat support 200 and the connecting member 210.

Figure 15:
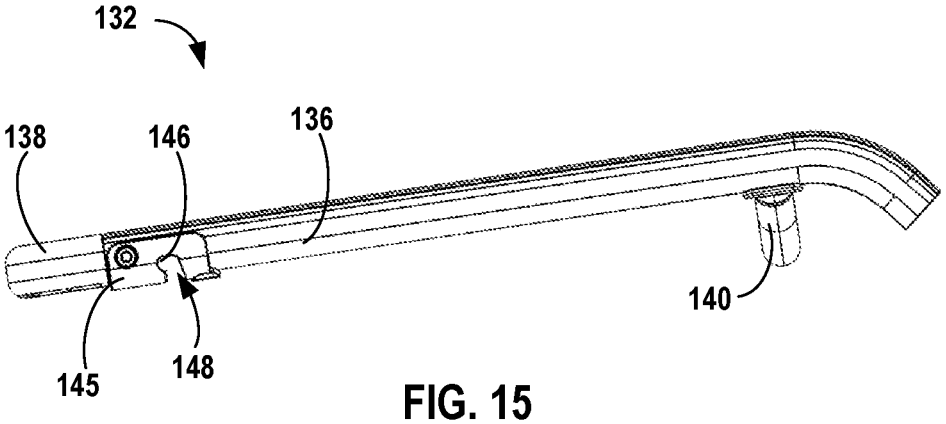
FIG. 15 depicts a side view of the seat frame of the portable chair of FIG. 1 according to aspects disclosed herein.
Figure 16:
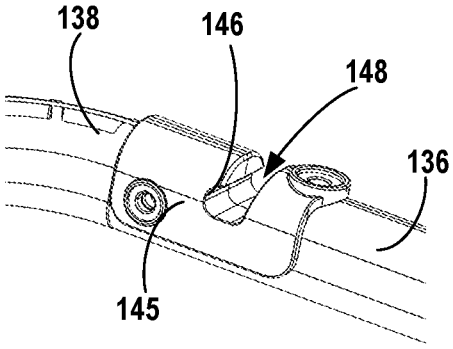
FIG. 16 depicts a partial bottom perspective view of the seat frame of FIG. 15 according to aspects disclosed herein.

In addition, each seat side rail 136 may releasably engage the pivot 208 with a hook 146 that is located on each seat side rail 136. As shown in FIGS. 15-16, the hook 146 may have an open end facing toward the forward end 104 of the chair 100, however, the hook 146 may have an open end facing toward the rearward end 106 of the chair 100. When the seat assembly 130 is installed onto the seat support assemblies 180, the pivot 208 of each seat support assembly 180 may be received in an aperture 148 adjacent the hook 146. Once the pivots 208 are received in the apertures 148, the seat assembly 130 may be moved forward until the pivots 208 are engaging the hooks 146. Once the hooks 146 engage the pivots 208, the apertures 194 of the forward seat supports will align with the receivers of the seat side rails 136 to allow the mechanical fastener 195 to be inserted to releasably secure the seat assembly 130 to the chair frame 110. The hooks 146 may be integrally formed on the seat side rails 136 or may be formed on a separate component like bracket 145 that may be fixedly connected to each of the seat side rails 136. Alternatively, the seat support assemblies 180 and the side seat rails 136 may be arranged such that the hook 146 engages a pivot connected to a front seat support 182 and a rear seat support has a receiver to allow the mechanical fastener to engage a rear seat support 200.

As discussed above, the seat assembly 130 may comprise a seat frame 132 and a seat fabric 134 that is connected to the seat frame 132. The seat frame 132 may include a pair of seat side rails 136 arranged opposite each other and connected to each other by a seat back rail 138. The seat fabric 134 may extend from each end portion across the seat frame 132 unsupported (i.e., the seat fabric 134 extends from the first seat side rail 136 to the second seat side rail 136 opposite the first seat side rail 136). A seat rib 140 may extend between the first seat side rail 136 and the second seat side rail 136, where the seat rib 140 has a central portion that has an upper surface that is spaced below and away from the seat fabric 134. The seat back rail 138 may extend between ends of the pair of seat side rails 136. The seat fabric 134 and the back fabric 154 may be configured to prevent deflection beyond a predetermined amount when supporting a user. For instance, the seat fabric 134 may be connected to the respective seat side rails 136 and then tensioned by fixedly connecting the seat rib 140 and seat back rail 138 to set the desired spacing between the seat side rails 136 while putting the seat fabric 134 in the optimal tension to support a user. Similarly, the back fabric 154 may be connected to the respective back side rails 156 and then tensioned by fixedly connecting the back ribs 158, 160 to set the desired spacing between the back side rails 156 while putting the back fabric 154 in the optimal tension to support a user.

Figure 6:
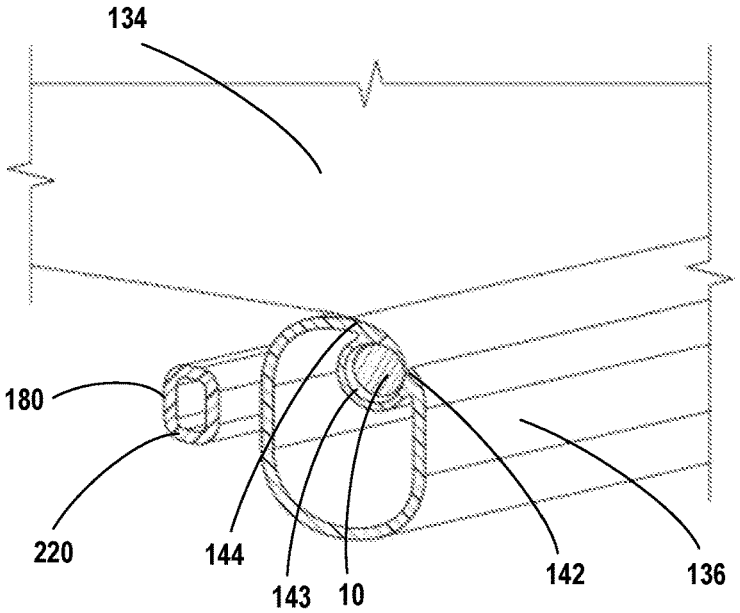
FIG. 6 depicts an enlarged partial cross-sectional perspective view of the seat assembly of the portable chair of FIG. 1 along line 6-6 according to aspects disclosed herein.

As shown in FIG. 6, each seat side rail 136 and each back side rail 156 may include a slot or groove 142 that extends along a majority or even an entire length of each side rail 136, 156. The groove 142 may lead to a channel 143. The slot or groove 142 may be located on an outboard portion of an upper surface 144 toward an outboard corner of each seat side rail 136 and each back side rail 156. The seat fabric 134 may be secured to each seat side rail 136 by inserting an end portion of the seat fabric 134 into the groove 142 located on each seat side rail 136. Similarly, the back fabric 154 may be secured to each back side rail 156 by inserting an end portion of the back fabric 154 into the groove 142. Each end portion of the fabrics 134, 154 may comprise a loop, where the loop is secured within the channel 143 of each side rail 136, 156 by a rod 10 that is inserted through the loop on each end portion of the fabrics 134, 154. While FIG. 6 illustrates the seat fabric 134 being secured to the seat side rail 136, the back fabric 154 may be secured to the back side rail 136 in the same manner. The width of the groove 142 may be less than the diameter of the rod 10, thereby preventing the rod 10 from exiting the channel 143 through the groove 142 and securing the seat fabric 134 to the seat frame 132. The seat side rails 136 and the back side rails 156 may have rounded corners, where the rails 136, 156 have a cross-sectional shape of a rounded rectangle with flat side surfaces and rounded corners. The rounded corners help to relieve any stress on each fabric 134, 154 as it exits the groove 142. By relieving the stress on the fabrics 134, 154 at the exit of the groove 142, the durability and life of the fabrics 134, 154 may be greatly increased. Each side rail 136, 156 may include an end cap 137 that helps to further secure each fabric 134, 154 to its corresponding side rail 136, 156.

Additionally, chair 100 may have a symmetric construction where components on a left side of the chair 100 may be mirrored to the components of the right side of the chair 100 (i.e., the front leg 112, 116, the back legs 114, 118, the seat support assemblies 180, the seat side rails 136, the backrest couplers 152, and the back side rails 156 may be mirror images of each when mirrored through a center plane that extends from the forward end 104 to the rearward end 106).

The back assembly 150 may include a removable back frame 153 that supports a back fabric 154. The back frame 153 may be removably connected to the backrest couplers 152. The back frame 153 may include a pair of back side rails 156 arranged opposite each other, a lower back rib 158 extending between the back side rails 156, and an upper back rib 160 extending between the back side rails 156 and spaced apart from and above the lower back rib 158. The back ribs 158, 160 may be substantially parallel to each other. In addition, the back ribs 158, 160 provide structural stability to the back frame 153. The back ribs 158, 160 may be spaced away from and behind the back fabric 154. In addition, the back side rails 156 may include one or more grommets 159 extending rearward from an outer surface. Each back side rail 156 may include a grommet 159 in an upper portion and a grommet 159 in a lower portion such that the grommets 159 on each back side rail 156 are spaced apart from each other. The grommets 159 may be configured to receive a strap or rope (not shown) or other apparatus to assist in carrying the chair 100 or attaching the chair 100 to another item. In some examples, the grommets 159 may be arranged only on one of the back side rails 156.

Figure 2:
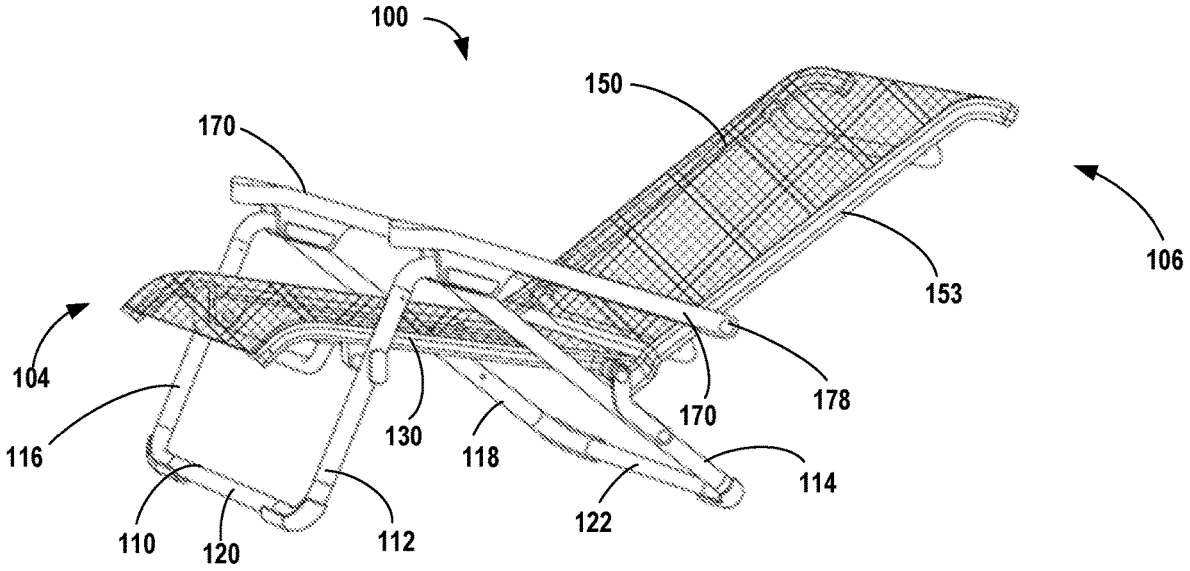
FIG. 2 depicts a top, right front perspective view of the portable chair of FIG. 1 in a use configuration in a reclined position according to aspects disclosed herein.
Figure 3:
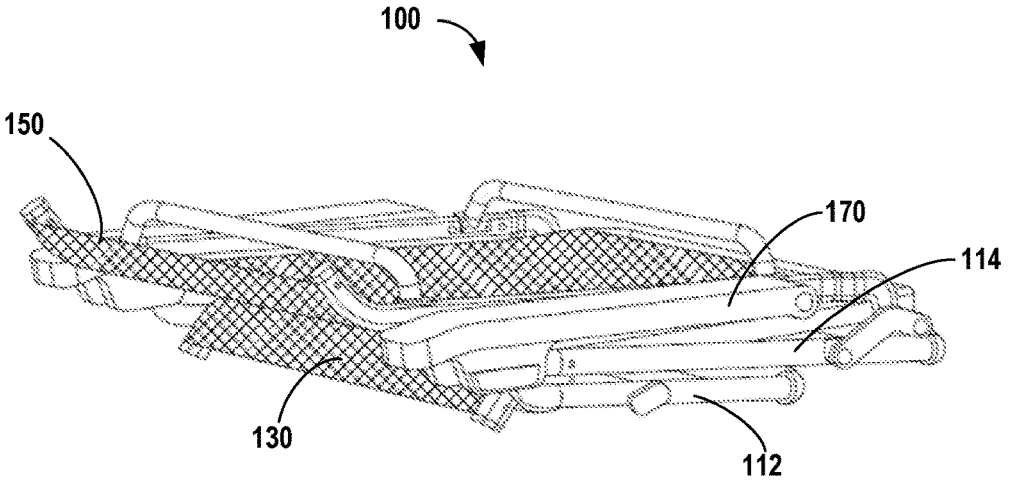
FIG. 3 depicts a perspective view of the portable chair of FIG. 1 in a folded configuration according to aspects disclosed herein.
Figure 4:
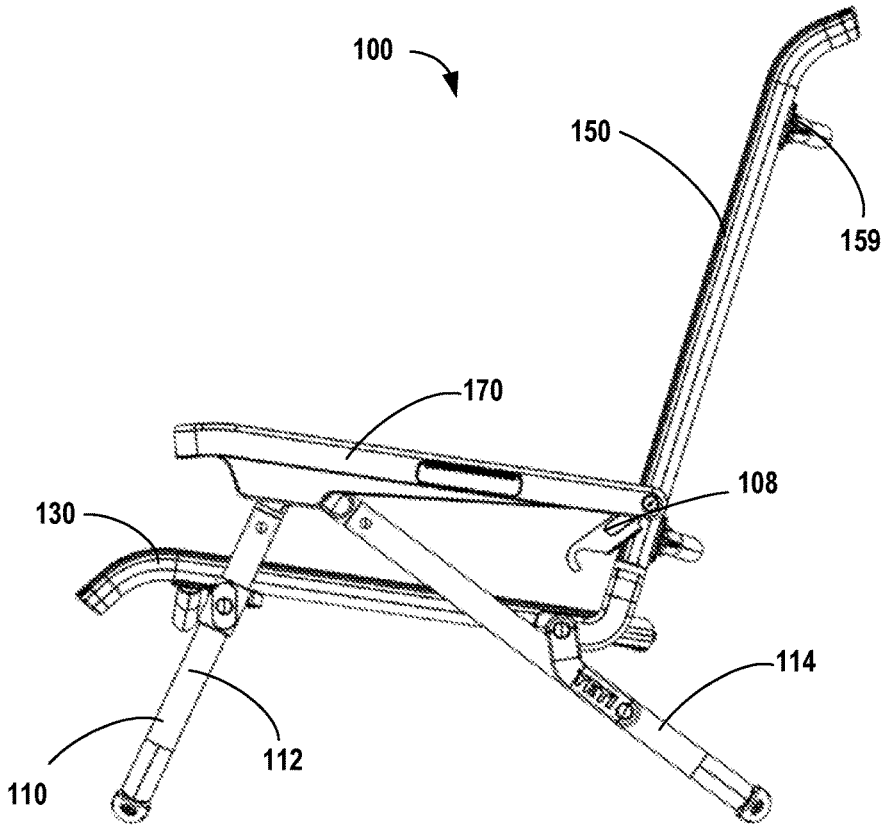
FIG. 4 depicts a right side view of an alternate example of the portable chair of FIG. 1 in an upright position according to aspects disclosed herein.
Figure 5:
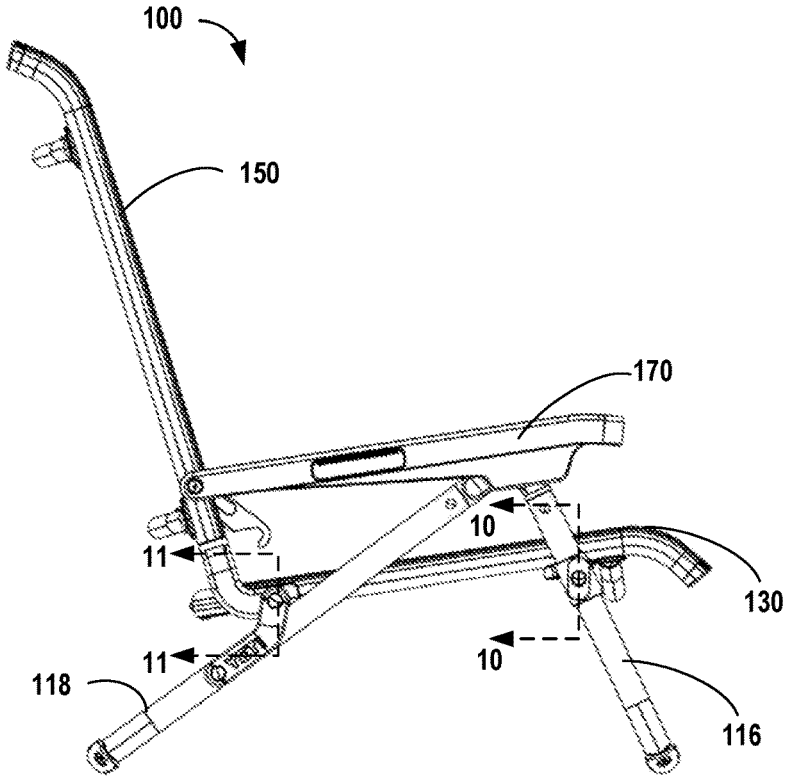
FIG. 5 depicts a left side view of the portable chair of FIG. 4 in an upright position according to aspects disclosed herein.

The portable chair 100 may be easily converted from the use configuration shown in FIG. 1 to a folded configuration shown in FIG. 3 for easy transport to another location or for storage. Through actuation of the rotational and pivotable interfaces, the portable chair 100 may be folded into a folded configuration as shown in FIG. 3 and unfolded into a use configuration as shown in FIGS. 1 and 2. In the folded configuration, the front legs 112, 116 may be substantially parallel to back legs 114, 118 and seat assembly 130 may be substantially parallel to back assembly 150. While in the folded configuration, the chair 100 may be locked and/or sustained in the folded configuration by a hook 108. The hook 108 may be pivotally connected to an armrest 170 and in some examples, may be pivotally connected to the back assembly 150. The hook 108 may releasably engage the connecting member 210 to prevent the chair 100 from unintentionally unfolding. In some examples, the hook 108 may engage other components of the chair frame 110 such as the back legs 114, 118, the rear seat support 200, or a portion of the chair frame 110.

The two front legs 112, 116, the two back legs 114, 118, the front sled 120, the back sled 122 along with the rails and ribs 136, 138, 140, 156, 158, 160 of the seat frame 132 and the back frame 153 may be cylindrical tubes, rectangular tubes with rounded corners, and/or shafts, or other hollow shape. The front legs 112, 116 and front sled 120 may be formed as an integral, single part. Similarly, the back legs 114, 118 and back sled 122 may be formed as an integral, single part. These components may be made of, for example, aluminum, titanium, stainless steel, scandium, metal alloys, polymers, composites, carbon fiber, and/or wood, such as bamboo. In instances in which aluminum, titanium, stainless steel, scandium, and/or metal alloys are used in the fabrication of the two front legs 112, 116, the two back legs 114, 118, the front sled 120, the back sled 122 along with the rails 136, 156, 160 of the seat frame 132 and the back frame 153, the metallic components may be hydroformed, cast, extruded, or formed by another method known to one skilled in the art. Furthermore, the metallic components may be treated through anodizing, plating, painting, powder coating, and/or the application of enamel in order to prevent corrosion induced by environmental conditions such as salt spray. Additionally, the metals and alloys used in the fabrication of the legs 112, 114, 116, 118, the sleds 120, 122, and the rails and ribs 136, 138, 140, 156, 158, 160 of the frames 132, 153 may be treated through annealing, case hardening, precipitation strengthening, tempering, normalizing, and/or quenching in order to increase hardness, toughness, and tensile and shear strength.

The fabrics 134, 154 may be a weave-type and/or mesh-like fabric. Additionally, the fabrics 134, 154 may be composed of any of a number of materials including, but not limited to, armored fabric cloth, sail fabric, awning fabric, Kevlar, tarp canvas, vinyl coated polyester, nylon mesh, neoprene, aluminized nylon, and/or cotton canvas. In some embodiments, the material may be treated to provide increased UV stabilization and weathering resistance, fire resistance, abrasion and tear resistance, and waterproofing. Additionally, the fabrics 134, 154 may be constructed of a weaved material with yarn having elastomeric properties. The elastomeric properties include the ability to stretch and deform under stress (i.e., increased elasticity), such as tension or weight. The elastomeric properties allow the fabric to return to its original form and the ability to resist creep and/or permanent deformation when the stress from the load is removed. In one example, the fabrics 134, 154 can be formed as a first yarn formed of an acrylic or polymer and blends and a second yarn formed of an elastomeric material such that the second yarn is more elastomeric than the first yarn. The elastomeric properties of the second yarn can help to provide the elastomeric properties of the fabrics 134, 154. In some instances, the fabrics 134, 154 may be composed of a similar materials such that the fabric 134 of the seat assembly 130 is the same as the fabric 154 of the back assembly 150. However, in some cases, the fabric 134 of the seat assembly 130 may be a different material than fabric 154 of the back assembly 150. For example, seat fabric 134 may be made of a first material and/or combination of materials, and back fabric 154 may be made of a second material and/or combination of materials different than the first material and/or combination of materials.

In addition, the portable chair 100 may be arranged in multiple seating positions from an upright position to multiple reclined positions. As shown in FIGS. 1 and 2, the portable chair 100 may be adjusted from an upright position shown in FIG. 1 to the reclined position illustrated in FIG. 2. In the upright position, the seat assembly 130 and the back assembly 150 may form an angle of approximately 99 degrees, while in the fully reclined position the seat assembly 130 and the back assembly 150 may form an angle of approximately 136 degrees. The chair 100 may have multiple reclined positions between the upright position and the fully reclined position. Accordingly, the chair 100 may have angular difference of approximately 37 degrees between the upright position and the fully reclined position, and may have an angular difference within a range of 30 degrees and 40 degrees between the upright position and the fully reclined position.

Figure 17:
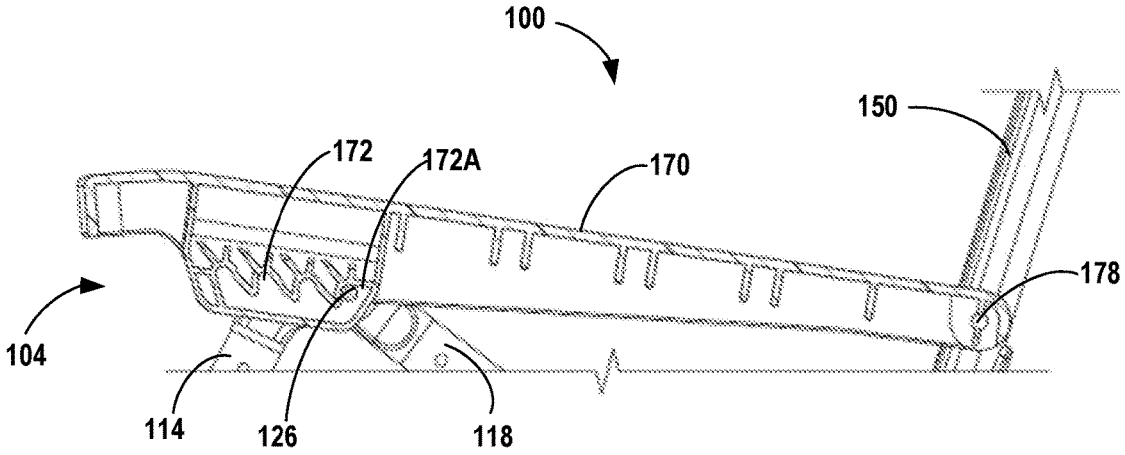
FIG. 17 depicts a side cross-sectional view through an armrest of the portable chair of FIG. 1 when the chair is in an upright position according to aspects disclosed herein.
Figure 18:
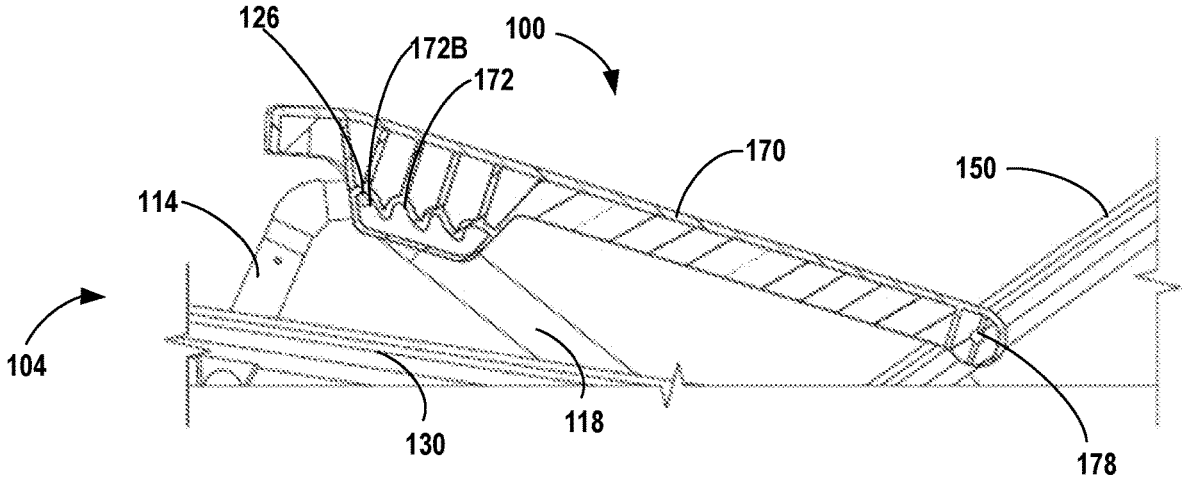
FIG. 18 depicts a side cross-sectional view through an armrest of the portable chair of FIG. 1 when the chair is in a reclined position according to aspects disclosed herein.

The adjustment of the portable chair 100 may be controlled by the relative position of each guide 126 relative to its corresponding armrest 170. As discussed above, each guide 126 is movably connected with a corresponding armrest 170 as well as pivotally connected to one of the first front leg 112 and the first back leg 114 or pivotally connected to one of the second front leg 116 and the second back leg 118. As shown in the cross-sectional views illustrated in FIGS. 17 and 18, each armrest 170 may include a set of internal receivers 172 that individually receive the guide 126. The position (i.e., the angle) of the back assembly 150 relative to the seat assembly 130 depends upon which receiver 172 the guide 126 is located. In some examples, each armrest 170 may have two sets of internal receivers 172 arranged on opposite sides of each armrest 170. Thus, the guide 126 may engage a receiver 172 in both sets of receivers 172 on both sides of each armrest concurrently. FIG. 17 illustrates the portable chair 100 is in an upright position, where the guide 126 is located in the rearward most receiver 172A. With the guide 126 in the rearward most receiver 172A, the armrest 170 is moved forward relative to the upper portions of the legs 112, 114, 116, 118 and the back assembly 150 is rotated forward. As the guide 126 is moved to each subsequent forward receiver 172 compared to the rearward most receiver 172A, the armrest 170 moves rearward relative to the upper portions of the legs 112, 114, 116, 118 and the back assembly 150 rotates rearward to a reclined position. FIG. 18 illustrates the location of the guide 126 is in the forwardmost receiver 172B, which corresponds with the chair 100 being in the fully reclined position. Each receiver 172 may have an opening at a bottom end of the receiver 172 with tapered sidewalls where each sidewall is angled toward a rearward end 106 of the chair 100. The tapered sidewalls of each receiver 172 help to direct the guide 126 into the selected receiver 172. The armrests 170 may also have an elongated hanger 174 located on an outboard surface 176 of each armrest 170. The hanger 174 may have an elongated shape and comprise a substantially U-shaped groove. In some examples, the hanger 174 may have a retention member that extends into an upper portion of the groove to help retain the items located within the groove. The hanger 174 may be configured to receive a strap or band to support an external bag or other item (not shown). The hanger 174 may be integral with the armrest 170 such that the hanger 174 is formed with the armrest 170, or the hanger 174 may be releasably connected (e.g., to the armrest 170 as a separate component).

The chair 100 may be easily adjusted to a desired recline position. In order to adjust the chair 100 from an upright position to a reclined position, a user may lean forward to relieve any pressure on the back assembly 150, then lift the armrests 170 and move the armrests 170 backward (i.e., away from the forward end 104 of the chair 100) such that the guide 126 engages a more forward receiver 172 than the previous receiver 172. A similar process may be used to move the chair 100 from a reclined position to a more upright position. To move the chair 100 from a reclined position to a more upright position, a user may lean forward to relieve any pressure on the back assembly 150, then lift the armrests 170 and move the armrests 170 or the back assembly 150 forward (i.e., toward from the forward end 104 of the chair 100) such that the guide 126 engages a more rearward receiver 172 than the previous receiver 172. In some examples, to move the chair 100 from a reclined position to a more upright position, a user may simply relieve pressure on the back assembly 150 and pull the back assembly 150 forward such that the guide 126 and the receivers 172 act in a ratcheting arrangement such that the guide 126 is received in a more rearward receiver 172 than the previous receiver 172. As shown in FIG. 17, the chair 100 may be in its most upright position when the guide 126 is located in the rearward most receiver 172A. When the chair 100 is in the folded configuration, the guides 126 may be disengaged from the receivers 172.

Figure 19:
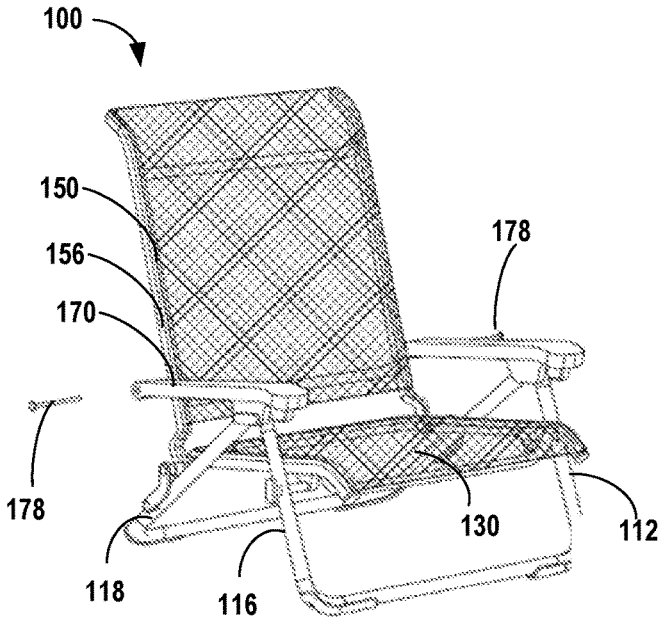
FIG. 19 depicts the portable chair of FIG. 1 in a partially unassembled state according to aspects disclosed herein.
Figure 20:
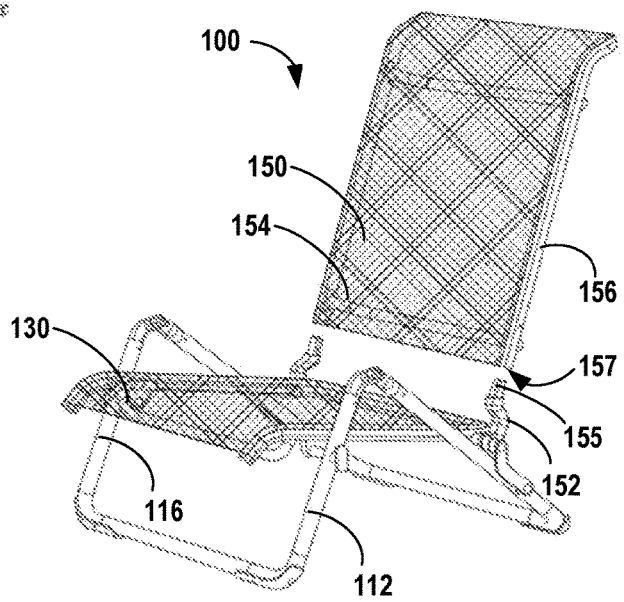
FIG. 20 depicts the portable chair of FIG. 1 in a partially unassembled state according to aspects disclosed herein.
Figure 21:
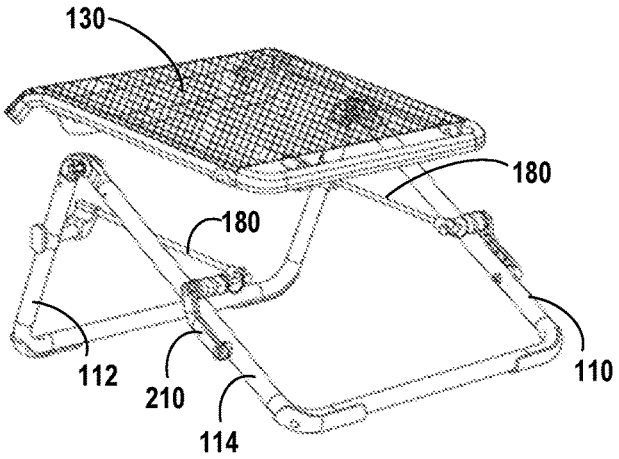
FIG. 21 depicts the portable chair of FIG. 1 in a partially unassembled state according to aspects disclosed herein.

FIGS. 19-20 illustrate the removal of the back assembly 150 from the chair 100. As discussed above, the back assembly 150 may be replaceable by a user. For example, the back assembly 150 may be replaced if the back assembly 150 is damaged or if a user wants a different back fabric 154. As discussed above, the back assembly 150 may be releasably connected to the chair 100. The back frame 153 may be releasably connected to the backrest couplers 152. Each back side rail 156 may have a bottom opening 157 to allow for an upper protrusion 155 of each backrest coupler 152 to be inserted. Alternatively, each back side rail 156 may include a protrusion that is received in an upper opening of each backrest coupler 152 to releasably connect the back frame 153 to the backrest couplers 152. An armrest pivot 178 may be inserted into an aperture in each armrest 170 and then through an aperture in the back side rail 156 to secure both the armrest 170 and the backrest coupler 152 to the back side rail 156. In some examples, the armrest pivot 178 may be secured via a threaded connection. The threaded connection may be located in the armrest 170, the backrest coupler 152, the back side rail 156, or a separate mechanical element that engages the armrest pivot 178. To replace the back assembly 150, the armrest pivots 178 may be removed to disengage each armrest 170 from its corresponding back side rail 156. Each armrest 170 remains connected to the chair frame 110 by each guide 126 that are coupled to their respective armrest 170. Additionally, once the armrest pivots 178 are removed, each back side rail 156 becomes slidably engaged with its corresponding backrest coupler 152. The back assembly 150 may then be slid off the backrest couplers 152 to allow it to be replaced as shown in FIG. 20. Thus, the back assembly 150 may be removed by removing the two armrest pivots 178 and sliding the back assembly 150 upward from the backrest couplers 152. FIG. 21 illustrates the seat assembly 130 being removed from the chair 100. As discussed above, the seat assembly 130 may be removed from the seat support assemblies 180 by removing the mechanical fasteners 195 and then lifting the seat frame 132 from the seat support assemblies 180. The seat support assemblies 180 help maintain the structural integrity of the chair frame 110 with the seat assembly 130 removed. While FIG. 21 also shows the back assembly 150 removed, the seat assembly 130 may be removed without removing the back assembly 150.

While various embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

We claim:

1. A portable chair comprising:
- a first front leg;
- a first back leg pivotally connected to the first front leg;
- a second front leg;
- a second back leg pivotally connected to the second front leg;
- a first seat support assembly connected to the first front leg and the first back leg, wherein the first seat support assembly comprises:
  - a first front seat support pivotally connected to the first front leg;
  - a first rear seat support pivotally connected to the first back leg by a rear pivot, wherein the first rear seat support includes a first aperture that receives the rear pivot, wherein the rear pivot pivotally connects the first rear seat support and the first back leg; and
  - a first strut extending between the first front seat support and the first rear seat support;
- a seat assembly releasably connected to the first seat support assembly, wherein the seat assembly comprises:
  - a pair of seat side rails, wherein a first seat side rail of the pair of seat side rails includes a second aperture, wherein the second aperture releasably receives the rear pivot;
  - a seat back rail extending between the pair of seat side rails; and
  - a seat fabric extending between the pair of seat side rails; and
- wherein the first seat side rail is supported by the first front seat support and the first rear seat support; and
- wherein the portable chair has a use configuration and a folded configuration.

2. The portable chair of claim 1, wherein the first strut is located inboard of the first seat side rail.

3. The portable chair of claim 1, wherein the first strut is substantially parallel to the first seat side rail.

4. The portable chair of claim 1, wherein the first rear seat support includes a support surface that comprises a concave portion that supports the first seat side rail.

5. The portable chair of claim 1, wherein the first front seat support includes a support surface having a concave shape that supports the first seat side rail.

6. The portable chair of claim 5, wherein the first front seat support includes an aperture below the support surface that receives a front pivot, wherein the front pivot pivotally connects the first front seat support and the first front leg.

7. The portable chair of claim 1, further comprising:

a back assembly pivotally connected to the first back leg and the second back leg, the back assembly comprising:

a first back side rail;

a second back side rail; and back fabric extending between the first back side rail and the second back side rail;

a first armrest pivotally connected to the first back side rail; and a second armrest pivotally connected to the second back side rail.

8. The portable chair of claim 7, wherein a first guide pivotally connects the first front leg and the first back leg, and a second guide pivotally connects the second front leg and the second back leg; and wherein the first armrest releasably engages the first guide, and the second armrest releasably engages the second guide.

9. The portable chair of claim 8, wherein when the portable chair is in the use configuration, the portable chair has an upright position and a reclined position, and wherein the first armrest includes a set of internal receivers that receive the first guide such that when the first guide is received in a rearward most receiver of the set of internal receivers, the portable chair is in the upright position and when the first guide is received in a receiver of the set of internal receivers located forward of the rearward most receiver, the portable chair is in the reclined position.

10. The portable chair of claim 7, wherein the back assembly is releasably connected to a pair of backrest couplers, and wherein an upper portion of a first backrest coupler of the pair of backrest couplers is inserted into a bottom opening of the first back side rail.

11. The portable chair of claim 10, wherein the first back side rail is secured to the first backrest coupler by an armrest pivot that is also pivotally connected to the first armrest.

12. A portable chair comprising:

a chair frame including:

a first front leg;

a second front leg;

a first back leg connected to the first front leg;

a second back leg connected to the second front leg;

a first seat support assembly including:

a first front seat support including a first concave surface; and a first rear seat support including a first pin;

a second seat support assembly including:

a second front seat support including a second concave surface; and a second rear seat support including a second pin; and a seat assembly including:

a first seat side rail including a first aperture and a first convex portion, wherein the first aperture releasably receives the first pin, and wherein the first concave surface releasably receives and supports the first convex portion;

a second seat side rail including a second aperture and a second convex portion, wherein the second aperture releasably receives the second pin, and wherein the second concave surface releasably receives and supports the second convex portion; and seat fabric extending between the first seat side rail and the second seat side rail.

13. The portable chair of claim 12, wherein the chair frame further comprises:

a first strut extending between the first front seat support and the first rear seat support, and a second strut extending between the second front seat support and the second rear seat support.

14. The portable chair of claim 12, wherein the chair frame further comprises:

a back assembly operably connected to the first back leg and the second back leg, the back assembly comprising:

a first back side rail;

a second back side rail;

back fabric extending between the first back side rail and the second back side rail; and a first armrest connected to the first back side rail; and a second armrest connected to the second back side rail.

15. The portable chair of claim 14, wherein a first guide pivotally connects the first front leg and the first back leg, and a second guide pivotally connects the second front leg and the second back leg; and wherein the first armrest is movably connected with the first guide, and the second armrest is movably connected with the second guide.

16. The portable chair of claim 14, wherein a hook is pivotally connected to the first armrest, wherein the hook releasably engages a portion of the chair frame to prevent the portable chair from unfolding when the portable chair is in a folded configuration.

17. The portable chair of claim 14, wherein the first back side rail is releasably connected to a first backrest coupler and the second back side rail is releasably connected to a second backrest coupler; and wherein the first backrest coupler is operably connected to the first back leg and the second backrest coupler is operably connected to the second back leg.

18. The portable chair of claim 17, wherein an upper portion of the first backrest coupler is inserted into an opening at a bottom of the first back side rail.

19. A portable chair comprising:

a first front leg;

a first back leg pivotally connected to the first front leg by a first guide;

a second front leg;

a second back leg pivotally connected to the second front leg by a second guide;

a back assembly including:

a first back side rail including a first bottom opening;

a second back side rail including a second bottom opening; and back fabric extending between the first back side rail and the second back side rail;

a first backrest coupler operatively coupled to the first back leg, wherein the first backrest coupler includes a first protrusion receivable in the first bottom opening of the first back side rail to removably couple the first back side rail to the first back leg;

a second backrest coupler operatively coupled to the second back leg, wherein the second backrest coupler includes a second protrusion receivable in the second bottom opening of the second back side rail to removably couple the second back side rail to the second back leg;

a first armrest, wherein the first armrest is pivotally connected to the first back side rail with a first removable armrest pivot, and wherein the first armrest is further connected to the first guide such that the first armrest is retained on the first guide when the first removable armrest pivot is removed; and a second armrest, wherein the second armrest is pivotally connected to the second back side rail with a second removable armrest pivot, and wherein the second armrest is further connected to the second guide such that the second armrest is retained on the second guide when the second removable armrest pivot is removed; and wherein when the first removable armrest pivot is removed and the second removable armrest pivot is removed, the back assembly is removed by sliding the first back side rail upward relative to the first backrest coupler and by sliding the second back side rail upward relative to the second backrest coupler.

* * * * *